US008931415B2

(12) United States Patent
Volkmann

(10) Patent No.: US 8,931,415 B2
(45) Date of Patent: Jan. 13, 2015

(54) INITIATION SYSTEMS FOR EXPLOSIVE DEVICES, SCALABLE OUTPUT EXPLOSIVE DEVICES INCLUDING INITIATION SYSTEMS, AND RELATED METHODS

(75) Inventor: Eric Volkmann, Plymouth, MN (US)

(73) Assignee: Alliant Techsystems Inc., Arlington, VA (US)

( * ) Notice: Subject to any disclaimer, the term of this patent is extended or adjusted under 35 U.S.C. 154(b) by 154 days.

(21) Appl. No.: 13/181,131

(22) Filed: Jul. 12, 2011

(65) Prior Publication Data

US 2012/0227609 A1 Sep. 13, 2012

Related U.S. Application Data

(60) Provisional application No. 61/368,946, filed on Jul. 29, 2010.

(51) Int. Cl.

| | |
|---|---|
| ***F42B 12/20*** | (2006.01) |
| ***F42B 12/02*** | (2006.01) |
| ***F42B 3/16*** | (2006.01) |
| ***F42C 19/08*** | (2006.01) |

(52) U.S. Cl.

CPC ..... *F42B 12/207* (2013.01); *F42B 12/02* (2013.01); *F42B 3/16* (2013.01); *F42C 19/0842* (2013.01)

USPC ..... 102/475; 102/217; 102/322; 102/305

(58) Field of Classification Search

USPC ..... 81/475, 305, 318, 320, 322, 331, 217, 81/499, 481

See application file for complete search history.

(56) References Cited

U.S. PATENT DOCUMENTS

| | | | | |
|---|---|---|---|---|
| 3,713,359 | A | 1/1973 | Andrew | |
| 3,714,897 | A * | 2/1973 | Parker | 102/475 |
| 3,724,379 | A * | 4/1973 | Davis | 102/374 |
| 3,730,049 | A | 5/1973 | Andrew | |
| 3,771,451 | A | 11/1973 | Woodring | |
| 3,877,376 | A * | 4/1975 | Kupelian | 102/492 |
| 4,026,213 | A * | 5/1977 | Kempton | 102/475 |
| 4,084,512 | A * | 4/1978 | San Miguel | 102/531 |

(Continued)

FOREIGN PATENT DOCUMENTS

| | | |
|---|---|---|
| WO | 2009038843 A2 | 3/2009 |
| WO | 2009038843 A3 | 3/2009 |

OTHER PUBLICATIONS

Sherman, Maurina S., The Right Bang for the Job, Yield-Select Ammunition, Lawrence Livermore National Laboratory Nuclear Technologies (DNT), S&TR Nov. 2004 , pp. 20-22.

*Primary Examiner* — Peter Poon
*Assistant Examiner* — Jonathan C Weber
(74) *Attorney, Agent, or Firm* — TraskBritt

(57) ABSTRACT

Initiator systems for warheads include a first initiation device configured to detonate at least a portion of an explosive material contained in an explosive device and a second initiation device configured to deflagrate at least a portion of an explosive material of a warhead. Scalable output explosive devices include an explosive material at least partially disposed within a housing and an initiator system including a first initiation device configured to detonate at least a portion of the explosive material and a second initiation device configured to deflagrate at least another portion of the explosive material. Methods of igniting warheads include deflagrating a portion of an explosive material disposed within the warhead and detonating at least another portion of the explosive material disposed within the warhead.

17 Claims, 6 Drawing Sheets

(56) References Cited

U.S. PATENT DOCUMENTS

| | | | | | |
|---|---|---|---|---|---|
| 4,411,199 | A | * | 10/1983 | Yates et al. | 102/481 |
| 4,522,448 | A | | 6/1985 | Nitzberg | |
| 4,658,727 | A | * | 4/1987 | Wilhelm et al. | 102/494 |
| 4,756,250 | A | | 7/1988 | Dias dos Santos | |
| 4,815,385 | A | * | 3/1989 | Kingery et al. | 102/320 |
| 4,848,239 | A | * | 7/1989 | Wilhelm | 102/492 |
| 5,035,181 | A | * | 7/1991 | Jacks et al. | 102/481 |
| 5,221,810 | A | * | 6/1993 | Spahn | 102/475 |
| 5,228,285 | A | * | 7/1993 | Van Name et al. | 60/253 |
| 5,229,542 | A | * | 7/1993 | Bryan et al. | 102/491 |
| 5,325,783 | A | | 7/1994 | Wong | |
| 5,348,597 | A | | 9/1994 | Wong | |
| 5,385,098 | A | | 1/1995 | Lindqvist et al. | |
| 5,388,518 | A | | 2/1995 | Wong | |
| 5,404,813 | A | | 4/1995 | Wong | |
| 5,450,794 | A | * | 9/1995 | Drimmer | 102/309 |
| 6,308,607 | B1 | | 10/2001 | Woodall et al. | |
| 6,352,029 | B1 | * | 3/2002 | Guirguis et al. | 102/286 |
| 6,622,632 | B1 | * | 9/2003 | Spivak | 102/475 |
| 6,952,995 | B2 | * | 10/2005 | Friedlander, III | 102/481 |
| 7,331,292 | B1 | * | 2/2008 | Kim et al. | 102/481 |
| 7,377,204 | B2 | | 5/2008 | Simmons | |
| 7,707,939 | B2 | | 5/2010 | Brent et al. | |
| 7,739,956 | B2 | * | 6/2010 | Ljungwald et al. | 102/481 |
| 7,891,297 | B1 | | 2/2011 | Rohr | |
| 7,946,207 | B1 | | 5/2011 | Porter et al. | |
| 8,033,221 | B2 | * | 10/2011 | Edwards | 102/213 |
| 8,371,224 | B1 | * | 2/2013 | Boswell et al. | 102/475 |
| 2003/0164109 | A1 | * | 9/2003 | Spivak | 102/475 |
| 2008/0245254 | A1 | | 10/2008 | Brent et al. | |
| 2011/0114726 | A1 | | 5/2011 | Porter et al. | |

* cited by examiner

INITIATION SYSTEMS FOR EXPLOSIVE DEVICES, SCALABLE OUTPUT EXPLOSIVE DEVICES INCLUDING INITIATION SYSTEMS, AND RELATED METHODS

CROSS-REFERENCE TO RELATED APPLICATION

This application claims the benefit of U.S. Provisional Patent Application Ser. No. 61/368,946, filed Jul. 29, 2010, entitled "Initiation Systems for Explosive Devices, Scalable Output Explosive Devices Including Initiation Systems, and Related Methods," the disclosure of which is incorporated herein by reference in its entirety.

TECHNICAL FIELD

Embodiments of the current disclosure relate generally to initiation systems and methods for explosive devices. In particular, embodiments of the current disclosure generally relate to ignition systems and methods configured to control the output of explosive devices.

BACKGROUND

Explosive devices used in military combat may be initiated by detonation devices. Explosive materials contained in an explosive device may be ignited in several different ways. Explosive materials have been ignited by flame ignition (e.g., fuzes or ignition of a priming explosive), impact (which often ignites a priming explosive), chemical interaction (e.g., contact with a reactive or activating fluid), or electrical ignition. Electrical ignition may occur in two distinct ways, as by ignition of a priming material (e.g., electrically ignited blasting cap or priming material) or by direct energizing of an explosive mass by electrical power. These various ignition systems enable explosive devices such as explosive projectiles to detonate at a desired time. Depending on the application, this desired time may be before impact, at a specific point during flight, during impact, or at some time delay after impact.

Generally, a fuze assembly for igniting the explosive materials contained in an explosive device activates the explosive projectile for detonation in the vicinity of the target. FIG. 1 is a cross-sectional view of an explosive device configured, for example, as a warhead 100. As shown in FIG. 1, the warhead 100 may include a housing 102 having an explosive material 104 disposed therein. The forward section of the warhead 100 may include a proximity sensor 106 configured to activate a fuze assembly 108 through wiring 109 disposed within the housing 102 of the warhead 100. In operation, the proximity sensor 106 may trigger the fuze assembly 108. Ignition of the fuze assembly 108 will generate a shock wave that propagates through the entirety of the explosive material 104 detonating the warhead 100. While detonation of the entire explosive material 104 contained in the warhead 100 may be desirable in some applications, detonation of the entire explosive material 104 may be undesirable in other applications. For example, detonation of the entire explosive material 104 may be undesirable where a smaller detonation is desirable due to factors such as target size, minimization of collateral damage, and other factors.

BRIEF SUMMARY

In some embodiments, the present disclosure includes an initiator system for an explosive device such as a warhead comprising a first initiation device configured to detonate at least a portion of an explosive material contained in an explosive device and a second initiation device configured to deflagrate at least a portion of an explosive material of the explosive device.

In additional embodiments, the present disclosure includes a scalable output explosive device comprising an explosive material at least partially disposed within a housing and an initiator system. The initiator system comprises a first initiation device disposed proximate the explosive material and configured to detonate at least a portion of the explosive material and a second initiation device disposed proximate the explosive material and configured to deflagrate at least another portion of the explosive material of the explosive device.

In yet additional embodiments, the present disclosure includes a method of igniting an explosive device such as a warhead. The method comprises deflagrating a portion of an explosive material disposed within the explosive device and detonating at least another portion of the explosive material disposed within the explosive device.

BRIEF DESCRIPTION OF THE SEVERAL VIEWS OF THE DRAWINGS

While the specification concludes with claims particularly pointing out and distinctly claiming that which is regarded as embodiments of the present disclosure, the advantages of embodiments of the disclosure may be more readily ascertained from the following description of embodiments of the disclosure when read in conjunction with the accompanying drawings in which:

DETAILED DESCRIPTION

The illustrations presented herein are not meant to be actual views of any particular material, apparatus, system, or method, but are merely idealized representations which are employed to describe embodiments of the present disclosure.

Additionally, elements common between figures may retain the same numerical designation for convenience and clarity.

As used herein the terms "explosive device" and "warhead" are generally used to refer to a variety of projectile type explosives such as, for example, artillery shells, rockets, bombs, and other weapons. In addition, these explosive devices may be launched from a variety of platforms such as, for example, fixed wing aircraft, rotary wing aircraft (e.g., helicopters), ground vehicles, and stationary ground locations. For example, a warhead may include an explosive material and initiation device that is delivered to a target by a propulsion system (e.g., a missile, a rocket, a torpedo, etc.) or by dropping the warhead from an aircraft.

Figure 1:
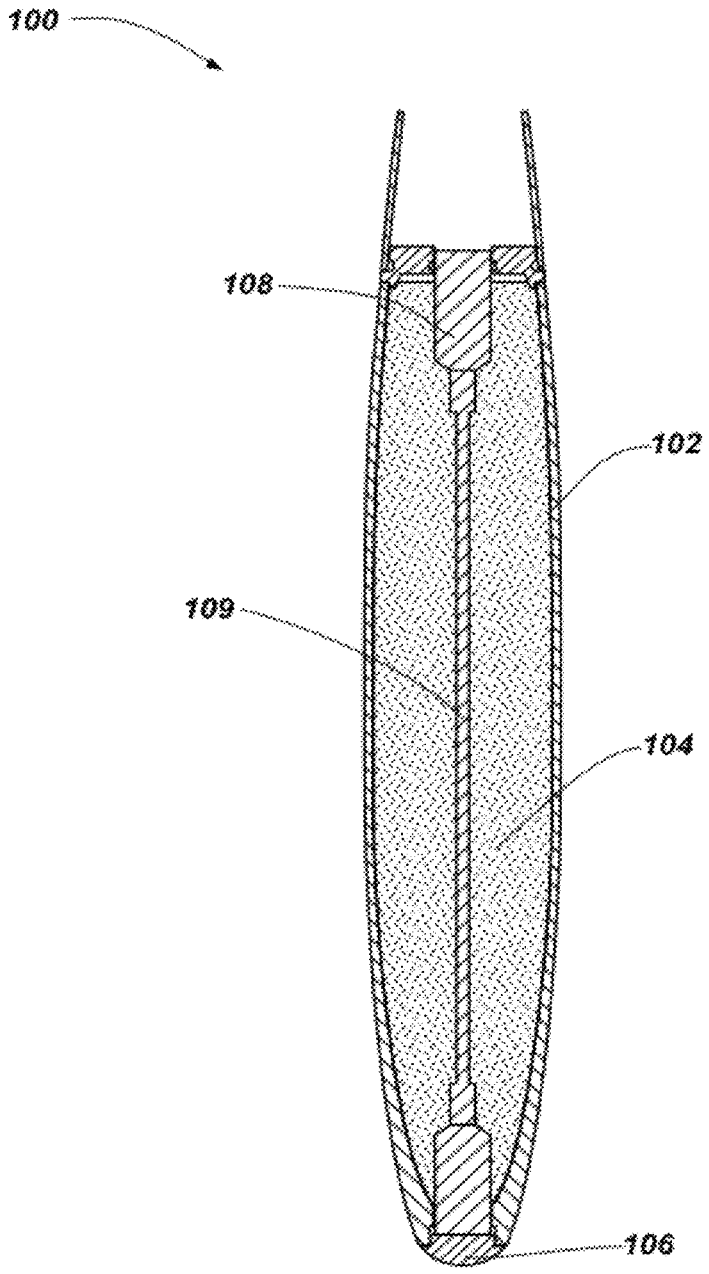
FIG. 1 is a cross-sectional view of a warhead.
Figure 2:
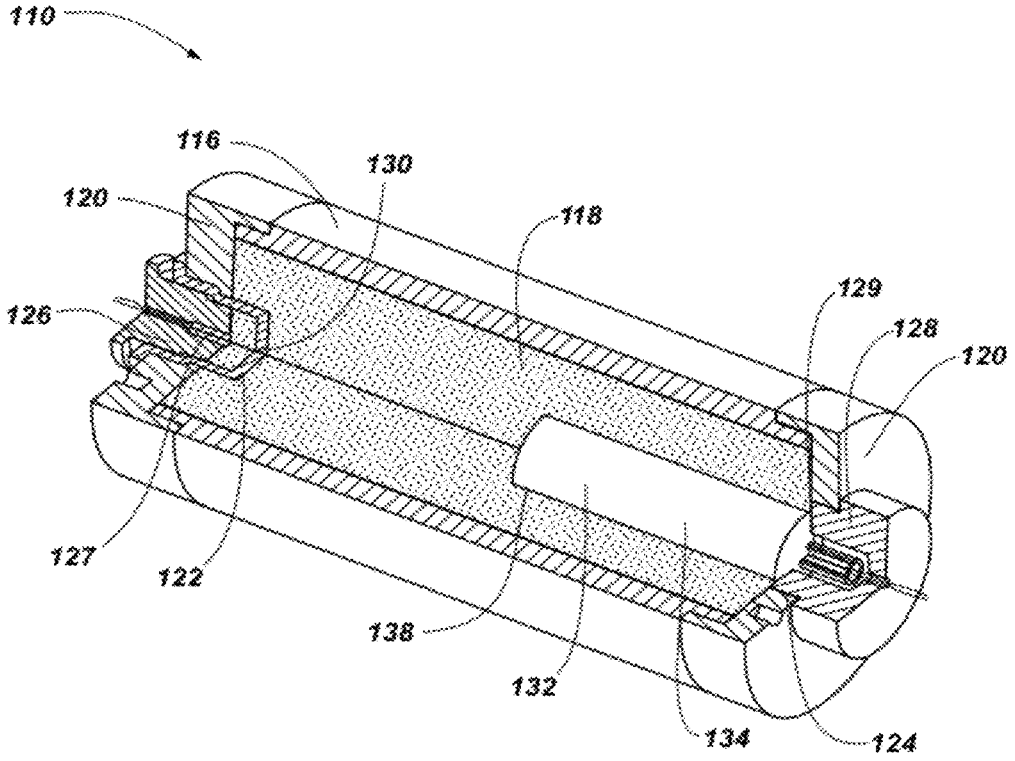
FIG. 2 is a partial cross-sectional perspective view of an explosive device in accordance with an embodiment of the present disclosure.

FIG. 2 is a partial cross-sectional perspective view of an explosive device in accordance with an embodiment of the present disclosure. As shown in FIG. 2, the explosive device 110 may comprise a housing 116 (e.g., a steel casing configured to fragment upon detonation) having an explosive material 118 (e.g., polymer-bonded explosives (PBX, PBXN), Pentaerythritol tetranitrate (PETN), LX-14, OCTOL, trinitrotoluene ("TNT"), cyclo-1,3,5-trimethylene-2,4,6 trinitramine ("RDX"), cyclotetramethylene tetranitramine ("HMX"), hexanitrohexaazaisowurtzitane ("CL -20"), C-4, combinations thereof, or any other suitable explosive material) disposed within the housing 116. The housing 116 of the explosive device 110 may include one or more end caps 120 welded or otherwise attached to the explosive device 110 at opposing ends thereof.

The explosive device 110 may include an initiation system comprising one or more initiation devices. For example, the initiation system may include a first initiation device 126 and a second initiation device 128. The first and second initiation devices 126, 128 may be at least partially disposed in fuze wells formed in the explosive device 110. For example, the first initiation device 126 may be disposed in a first fuze well 122 formed in the housing 116 (e.g., one of the end caps 120) and the explosive material 118 at a first end of the explosive device 110. The second initiation device 128 may be disposed in a second fuze well 124 formed in the housing 116 (e.g., one of the end caps 120) and the explosive material 118 at a second, opposing end of the explosive device 110. In some embodiments, the first and second initiation devices 126, 128 may be partially disposed at opposing ends of the explosive material 118 and may partially extend through a portion of the explosive material 118 only an axis thereof (e.g., a longitudinal axis).

The first initiation device 126 may include an initiator 127 (e.g., an exploding foil initiator (EFI), a low energy exploding foil initiator (LEEFI), blasting cap, exploding-bridgewire detonator (EBW), etc.) and a detonation device such as, for example, an explosive booster 130 (e.g., PETN, RDX, etc.) disposed within the explosive device 110 proximate to the initiator 127. Initiation of the first initiation device 126 may ignite the explosive booster 130 which may detonate the explosive material 118 in the explosive device 110. In other words, detonation of the explosive booster 130 generates a shock wave (e.g., a supersonic shock wave) that propagates through the explosive material 118 contained in the housing 116. In order to initiate the first initiation device 126, a portion of the initiation system (e.g., a fuzing unit 227 (FIG. 5)) may transmit a voltage (e.g., a voltage between about 500 volts and about 1500 volts) to the first initiation device 126 (e.g., a LEEFI) sufficient to ignite the first initiation device 126.

The second initiation device 128 may include an initiator 129 (e.g., an exploding foil initiator (EFI), a low energy exploding foil initiator (LEEFI), blasting cap, exploding-bridgewire detonator (EBW), etc.) and a deflagration device 132 configured to ignite and burn a portion of the explosive material 118 contained in the housing 116 of the explosive 110. For example, the deflagration device 132 may include a housing 134 (e.g., a cylindrical housing formed from a metal, a metal alloy, a composite, a ceramic, etc.) having an explosive material (e.g., PBX, PBXN, PETN, LX-14, C-4, OCTOL, TNT, RDX, HMX, combinations thereof, or any other suitable explosive material) disposed therein. In order to initiate the second initiation device 128, a portion of the initiation system (e.g., a fuzing unit 227 (FIG. 5)) may transmit a voltage (e.g., a voltage between about 500 volts and about 1500 volts) to the second initiation device 128 (e.g., a LEEFI) sufficient to ignite the second initiation device 128. In some embodiments, the deflagration device 132 may include a deflagration device such as those available from the Battelle Memorial Institute in Columbus, Ohio and the Lawrence Livermore National Laboratory in Livermore, Calif. For example, the deflagration device 132 may include a shaped charge that will produce a jet capable of initiating a burning reaction in a portion of the explosive material 118, but that will not substantially initiate a detonation of the explosive material 118.

As shown in FIG. 2, the deflagration device 132 may be disposed in a cavity 138 formed in the explosive device 110. For example, the cavity 138 may be formed in a portion of the explosive material 118, in a portion of the housing 116 (e.g., the end cap 120) and in a portion of the second initiation device 128. A portion of the explosive device 110 (e.g., the initiation system) may be configured to at least partially prevent the initiation energy from initiation of the deflagration device 132 from detonating surrounding portions of the explosive material 118 in the explosive device 110. In other words, the explosive device 110 may enable a portion of the explosive material 118 that is ignited by the deflagration device 132 to be subjected to deflagration (e.g., a subsonic combustion propagated, for example, through thermal conductivity) rather than a supersonic detonation. The deflagration of a portion of the explosive material 118 may be used to reduce the amount of overall explosive material 118 in the explosive device 110 before detonation of the explosive material 118 by the first initiation device 126. Consequently, the reduction of the amount of overall explosive material 118 in the explosive device 110 through deflagration of a portion of the explosive material 118 enables the output of the explosive device 110 to be selectively reduced.

In operation, the explosive device 110 may be used to provide a scalable output (e.g., explosive output causing fragmentation of the housing 116) depending on the timing of the initiation of the initiation system. For example, one or more initiation devices (e.g., the second initiation device 128 including the deflagration device 132) may be initiated. As discussed above, initiation of the deflagration device 132 causes a portion of the explosive material 118 to deflagrate. The initiation system may then delay sending another signal to the remaining initiation device (e.g., the first initiation device 126) by a predetermined amount of time. For example, the initiation system or user thereof may delay initiation of the first initiation device 126 including the explosive booster 130 for detonating the remaining explosive material 118 until the desired amount of explosive material 118 has been deflagrated. In other words, the initiation of the first initiation device 126 including the explosive booster 130 may be delayed a selected time period (e.g., between 0.1 microsecond to 1 millisecond) from the initiation of the second initiation device 128 including the deflagration device 132 depending on the amount of deflagration of the explosive material 118 (i.e., reduction of the explosive material 118) that is desired.

Figure 3:
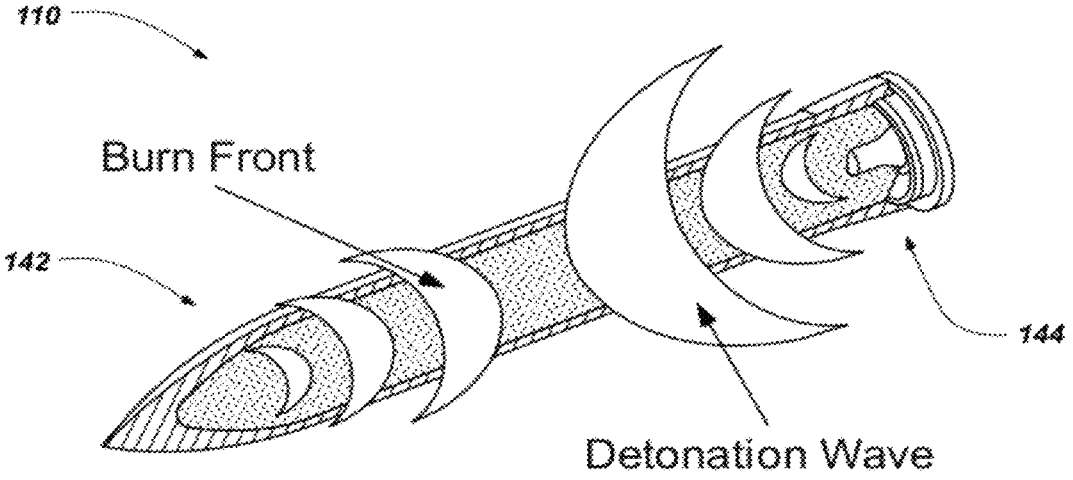
FIG. 3 is a simplified, partial cross-sectional perspective view of an explosive device in accordance with yet another embodiment of the present disclosure.

As shown in FIG. 3, in some embodiments, the initiation of the deflagration device 132 (FIG. 2) may propagate a burn front from an end (e.g., a forward end 142) of the explosive device 110 toward another end of the explosive device 110 (e.g., an aft end 144). The initiation of an initiation device configured to detonate explosive material (e.g., the first initiation device 126 including the explosive booster 130 (FIG. 2)) may propagate a detonation wave from an end (e.g., an aft end 144) of the explosive device 110 toward another end of the explosive device 110 (e.g., a forward end 142). As discussed above, propagation of the burn front prior to the propagation of a detonation wave may enable the output of the explosive device 110 to be scaled depending on the desired amount of explosive output by deflagrating a portion of the explosive material before detonation.

Figure 4:
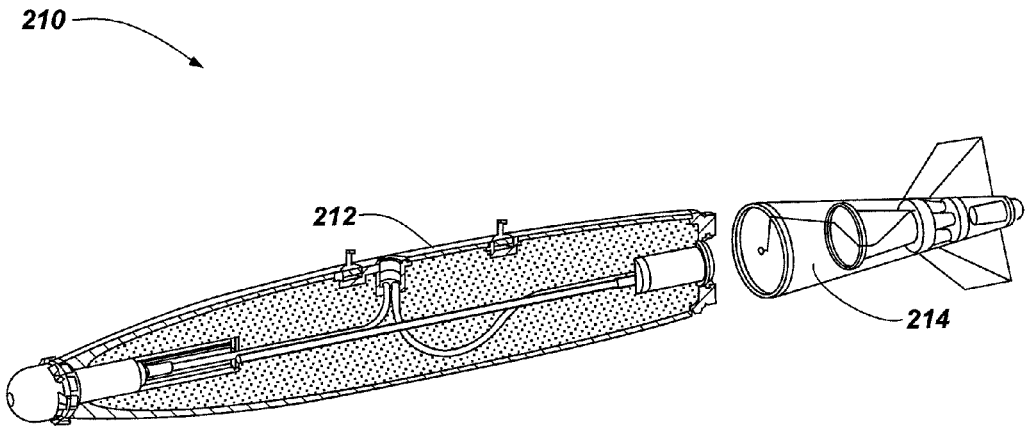
FIG. 4 is a cross-sectional perspective view of an explosive device in accordance with another embodiment of the present disclosure.

FIG. 4 is a partial cross-sectional perspective view of an explosive device in accordance with an embodiment of the present disclosure. As shown in FIG. 4, the explosive device 210 (e.g., a penetrator, a Bomb Live Unit such as the BLU-111, etc.) may include an explosive section such as, for example, a warhead 212 and a guidance system 214 used to navigate the explosive device 210.

Figure 5:
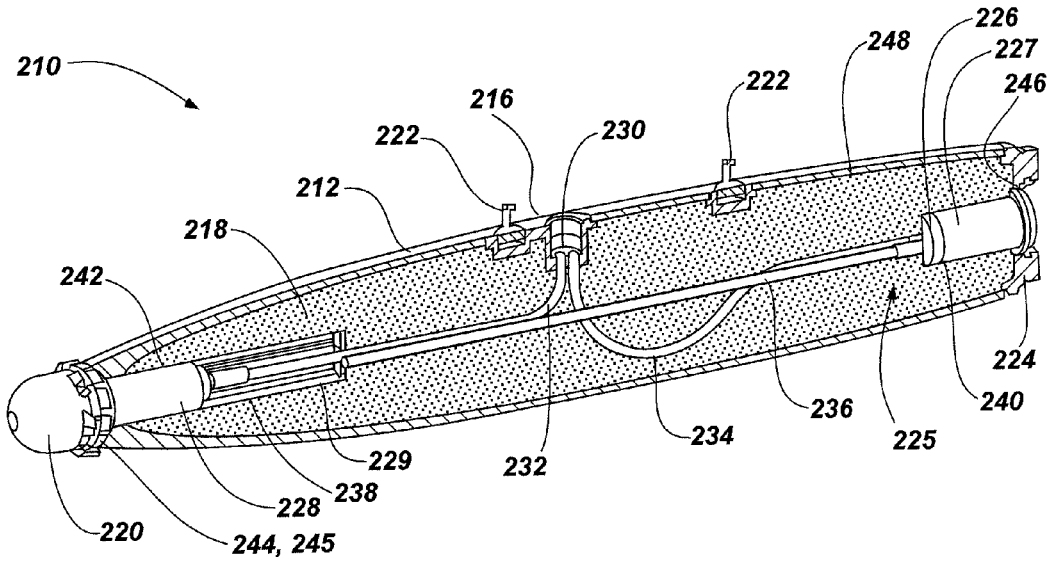
FIG. 5 is an enlarged, partial cross-sectional perspective view of a portion of the explosive device shown in FIG. 4.

FIG. 5 is an enlarged, partial cross-sectional perspective view of a portion of the explosive device 210 shown in FIG. 4. As shown in FIG. 5, the warhead 212 of the explosive device 210 may comprise a housing 216 (e.g., a steel casing) having an explosive material 218 (e.g., PBX, PBXN, PETN, LX-14, C-4, OCTOL, TNT, RDX, HMX, combinations thereof, or any other suitable explosive material) disposed within the housing 216. In some embodiments, the warhead 212 of the explosive device 210 may include a proximity sensor 220 disposed in the forward end of the warhead 212 (e.g., in a portion of a first fuze well 240). For example, the proximity sensor 220 may include a radar proximity sensor such as, for example, the DSU-33 manufactured by Alliant Techsystems Inc. of Arlington, VA. In other embodiments, the proximity sensor 220 may include other suitable location devices (e.g., a laser sensor, a sonar sensor, etc.). In some embodiments, the warhead 212 may include one or more attachment devices (e.g., bomb lugs 222) for attaching the explosive device 210 to a launch platform (e.g., fixed wing aircraft, rotary wing aircraft, ground vehicles, and stationary ground locations). In some embodiments, the explosive device 210 may include an attachment structure 224 for coupling a guidance system 214 (FIG. 4) to the warhead 212.

The explosive device 210 may include an initiation system 225 comprising one or more initiation devices. For example, the initiation system 225 may include a fuze 227 (e.g., a fuze munitions unit (FMU) such as, for example, a FMU-139 C/B), a first initiation device 226, and a second initiation device 228, each including an initiator (e.g., an exploding foil initiator (EFI), a low energy exploding foil initiator (LEEFI), blasting cap, exploding-bridgewire detonator (EBW), etc.). The first and second initiation devices 226, 228 may be at least partially disposed in fuze wells 240, 242 formed in the explosive device 210. For example, the first initiation device 226 may be disposed in the first fuze well 240 formed in the housing 216 and the explosive material 218 at a first end of the explosive device 210. The second initiation device 228 may be disposed in the second fuze well 242 formed in the housing 216 and the explosive material 218 at a second, opposing end of the explosive device 210.

In some embodiments, the initiation system 225 may include a fuzing unit (FZU) 230 that provides operating power to the first initiation device 226 and the second initiation device 228 and connection between the first and second initiation devices 226, 228. In some embodiments, the FZU 230 may provide connection to other components of the explosive device 210 or control systems thereof. The FZU 230 may include a FZU assembly (e.g., a FZU-39/B, a FZU-48/B, a FZU-55/B, a FZU-60/B, etc.). The FZU 230 may be in communication (e.g., electrical connection) with the first and second initiation devices 226, 228 and, where applicable, with the proximity sensor 220. For example, a first connection 232 may extend from the proximity sensor 220 to the FZU 230. A second connection 234 may extend from the FZU 230 to one or more initiation devices (e.g., the first initiation device 226). A third connection 236 may extend from the second initiation device 228 to another component of the explosive device 210 such as, for example, the first initiation device 226. In other embodiments, the second initiation device 228 may be connected directly to the FZU 230.

In operation, the proximity sensor 220 may transmit a signal to the fuze 227 on occurrence of a predetermined event (e.g., a selected proximity to a target is detected). The fuze 227 may transmit a signal to one of more of the initiation devices 226, 228. For example, the fuze 227 may transmit a signal to one or more of the initiation devices 226, 228 in order to detonate the initiation devices 226, 228. In some embodiments, the fuze 227 transmits a signal (e.g., a voltage between about 500 volts and about 1500 volts) to the one of the initiation devices 226, 228 and then may delay sending another signal to the remaining initiation device (e.g., the first initiation device 226) by a predetermined amount of time.

In some embodiments, the initiation system 225 may include initiation devices 226, 228 somewhat similar to the initiation devices 126, 128 described above with reference to FIG. 2. The first initiation device 226 may include an initiator and an explosive booster disposed within the explosive device 210. Initiation of the first initiation device 226 may ignite the explosive booster that may detonate the explosive material 218 in the explosive device 210. The second initiation device 228 may include an initiator and a deflagration device 229 configured to ignite and burn a portion of the explosive material 218 contained in the housing 216 of the explosive 210. The deflagration device 229 may be disposed in a cavity 238 formed in the explosive device 210.

The initiation system 225 may enable the explosive device 210 to provide a scalable output depending on the timing of the initiation of the components (e.g., the initiation devices 226, 228) of the initiation system 225. For example, one or more initiation devices (e.g., the second initiation device 228 including the deflagration device 229) may be initiated as discussed above. The initiation system 225 may then delay sending another signal to the remaining initiation device (e.g., first initiation device 226) by a predetermined amount of time depending on the amount of deflagration of the explosive material 218 that is desired.

In some embodiments, the initiation system 225 may include a safe and arm device (also termed a SAD or an S&A). Safe and arm devices may include an assembly or system that mechanically or electrically (i.e., electronic safe and aim devices (ESADs)) interrupts an explosive train and prevents inadvertent functioning of the initiation system 225. For example, an ESAD may isolate electronic components between a power source (e.g., the FZU 230) and an initiator (e.g., the initiation devices 226, 228) to inhibit inadvertent detonation of the explosive material 218.

Figure 6:
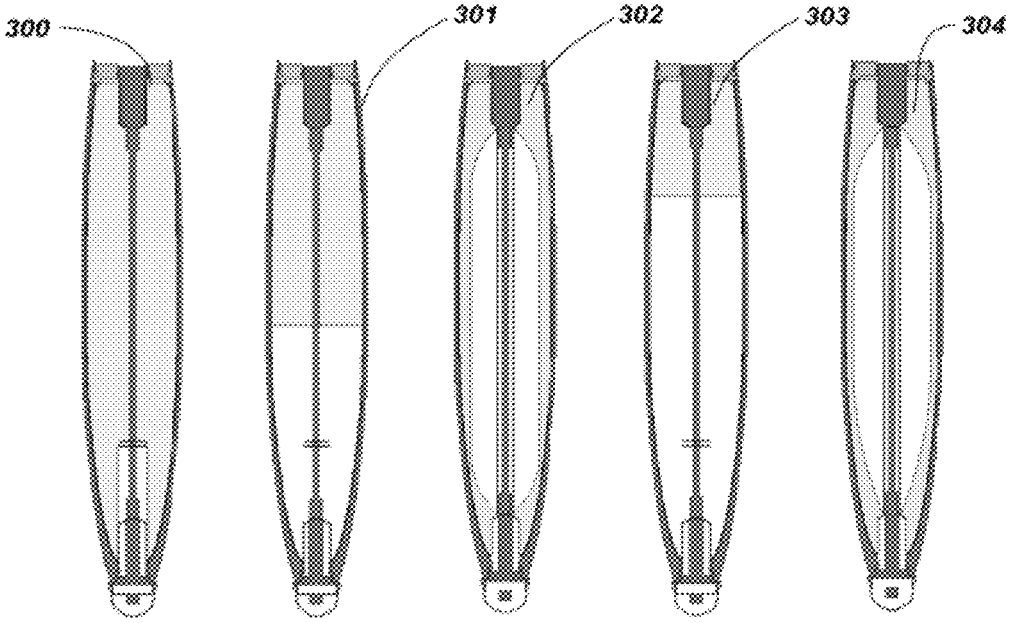
FIG. 6 is a comparison of five explosive devices in accordance with embodiments of the present disclosure shown in a cross-sectional view having varying amounts of explosive material disposed therein.

FIG. 6 illustrates a comparison of five explosive devices (e.g., the explosive device 210), shown in a cross-sectional view having varying amounts of explosive material disposed therein. It is noted that FIG. 6 represents simplified illustrations of the explosive devices and does not show details such as case expansion and burned explosive by-products. Explosive device 300 shows an explosive device containing a full amount or substantially full amount of the explosive material disposed therein at the time of detonation of the explosive device 300 (e.g., at the time of detonation of the first initiation device 226 having an explosive booster (FIG. 4)). An explosive device 300 having the full amount of explosive material at the time of detonation may be achieved by a long time delay on deflagration initiation (e.g., initiation of the second initiation device 228 including the deflagration device 229 (FIG. 4)) subsequent the launch of the explosive device and resulting in a full detonation (i.e., maximum output). In other words, the deflagration of the explosive material is not initiated until a time proximate to the time of detonation of the explosive device 300. For example, the deflagration initiation may be initiated at substantially the same time as detonation of the explosive material contained in the explosive device 300.

Explosive devices 301 and 302 show an explosive device containing approximately fifty percent (50%) of the explosive material disposed therein at the time of detonation. Explosive device 301 shows fifty percent (50%) of the explosive material having been deflagrated through an axial burn and explosive device 302 shows fifty percent (50%) of the explosive material having been deflagrated through a radial burn. The explosive devices 301, 302 having reduced amounts of explosive material (e.g., fifty percent (50%)) at the time of detonation may be achieved by initiating a deflagration initiation (e.g., initiation of the second initiation device 228 including the deflagration device 229) and delaying detonation of the remaining explosive material until approximately fifty percent (50%) of the explosive material has been deflagrated. After the desired amount of explosive material has been deflagrated, the remaining explosive material may be detonated (e.g., by detonation of the first initiation device 226 having an explosive booster (FIG. 4)).

Explosive devices 303 and 304 show an explosive device containing approximately twenty-five percent (25%) of the explosive material disposed therein at the time of detonation. Explosive device 303 shows twenty-five percent (25%) of the explosive material having been deflagrated through an axial burn and explosive device 304 shows twenty-five percent (25%) of the explosive material having been deflagrated through a radial burn. The explosive devices 303, 304 having reduced amounts of explosive material (e.g., twenty-five percent (25%)) at the time of detonation may be achieved by initiating a deflagration initiation (e.g., initiation of the second initiation device 228 including the deflagration device 229) and delaying detonation (e.g., detonation of the first initiation device 226 having an explosive booster (FIG. 4)) of the remaining explosive material until approximately seventy-five percent (75%) of the explosive material has been deflagrated.

In some embodiments, substantially all of the explosive material (i.e., approximately one-hundred percent (100%)) may be deflagrated in the explosive device to substantially disarm the explosive device and minimize damage. For example, the explosive device may be used to deflagrate substantially all of the explosive material disposed therein and self-destruct in the event of a guidance, navigation, and control (GNC) or other weapon sub-system failure.

Figure 7:
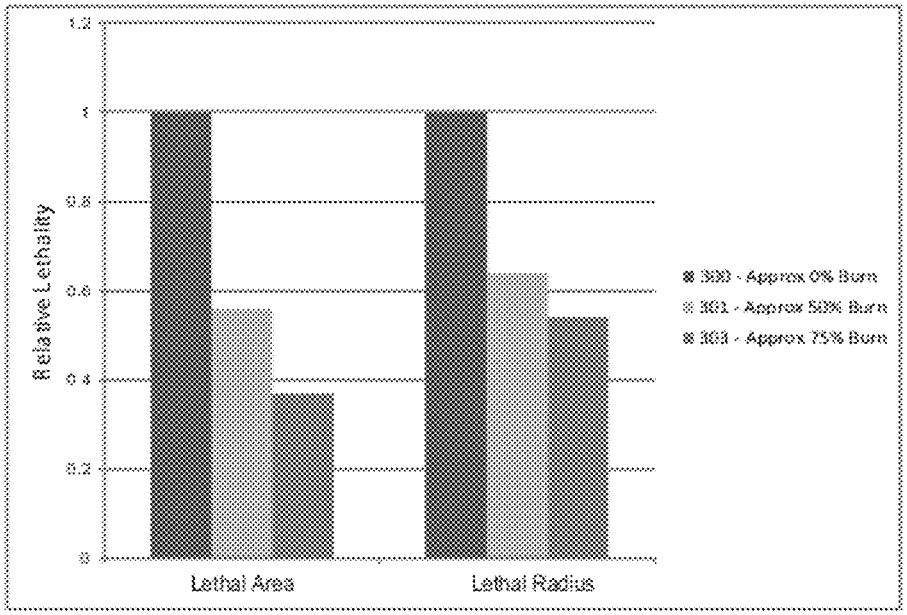
FIG. 7 is a graph illustrating the relative results of modeling of the lethal effects of the explosive devices shown in FIG. 6.

FIG. 7 illustrates the results of mathematical modeling of the lethal effects of the explosive devices 300, 301, 303, each having varying amounts of explosive material therein at a time of detonation on an example target. The relative lethality with respect to explosive device 300 having a full amount or substantially full amount of the explosive material disposed therein was calculated for explosive devices 301, 303 which devices have reduced amounts of explosive material relative to the explosive device 300, approximately fifty percent (50%) and twenty-five percent (25%), respectively.

It is noted that while the embodiments of FIGS. 6 and 7 describe deflagration of seventy-five percent (75%) and fifty percent (50%) of the explosive material, the scalable output of the explosive devices described herein may include an unlimited number of selectable outputs, as the initiation system of the explosive devices or users thereof may select any number of delay times between initiation of the initiation devices. In some embodiments, the scalable output of the explosive devices may enable the explosive devices or users thereof to select the output of the explosive device as a fraction of the explosive device's total explosive yield (i.e., a "Lethality Index") for each desired target and collateral damage zone.

Figure 8:
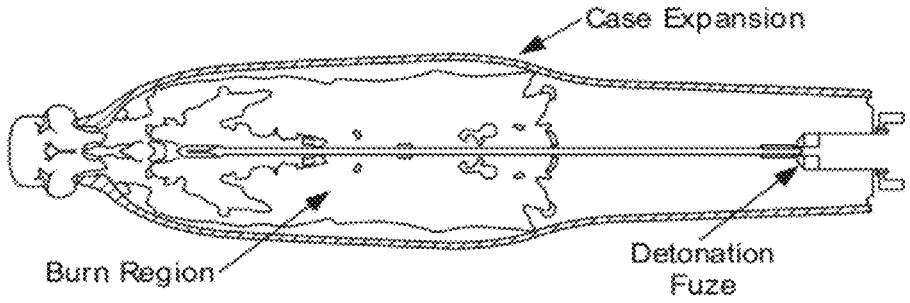
FIG. 8 illustrates a simulation of deflagration of an explosive material disposed within an explosive device in accordance with another embodiment of the present disclosure shown in a cross-sectional view.

FIG. 8 is a simulation of deflagration of an explosive material disposed within an explosive device in accordance with another embodiment of the present disclosure shown in a cross-sectional view. As shown in FIG. 8, deflagration of the explosive material may cause the housing to expand. Expansion of the housing may enable pressure and gases generated by the deflagration of the explosive material to vent. In some embodiments, expansion of the housing may also promote deflagration of the explosive material and may at least partially prevent the explosive material from being detonated.

In some embodiments, the explosive device may also be configured to prevent unintentional detonation of the explosive material in the explosive device. For example, the explosive device may be configured to prevent unintentional detonation caused by an external impact (e.g., bullet impact, fragment impact, sympathetic detonation, or shaped charge jet impact), explosion, etc. As discussed above, expansion of the housing may promote deflagration of the explosive material and may prevent the explosive material from being detonated unintentionally. Referring back to FIG. 5, the explosive device 210 may include one or more vents 244 formed in the housing 216 at the forward end of the explosive device 210. In some embodiments, the vent 244 may be formed in at an external portion of the first fuze well 240 and may have a thermoplastic ring 245 disposed therein. For example, the proximity sensor 220 may include a thermoplastic ring 245 disposed in an outer portion of the first fuze well 240. During a heating event (e.g., a fire, an explosion, etc.), the thermoplastic ring 245 in the first fuze well 240 may melt and enable the explosive device 210 to safely vent the explosive material 218 disposed therein without detonation of the explosive device 210. In some embodiments, the aft end of the explosive device 210 may include one or more vents 246 to enable the explosive device 210 to safely vent the explosive material 218 disposed therein without detonation of the explosive device 210.

In some embodiments, the housing 216 of the explosive device 210 may also include a reactive material liner 248 (e.g., a liner formed from generally nonexplosive materials that will explode or burn after being subjected to relatively large magnitudes of stimulus) formed between the housing 216 and the explosive material 218. The reactive material liner 248 may act as a shock liner to mitigate the unintentional detonation of the explosive material 218 in the explosive device 210 responsive to an undesired stimulus. During the detonation of the explosive device 210, the reactive material liner 248 may also contribute to the explosive force after being ignited by detonation of the surrounding explosive material 218.

Figure 9:
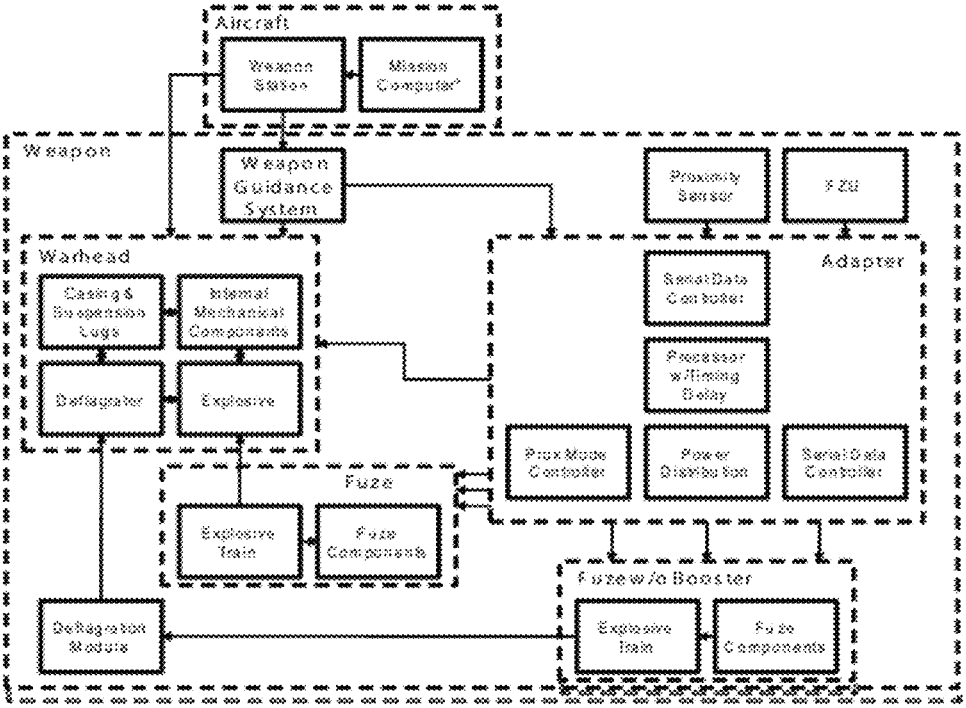
FIG. 9 is a system architecture of an explosive device in accordance with another embodiment of the present disclosure.
Figure 10:
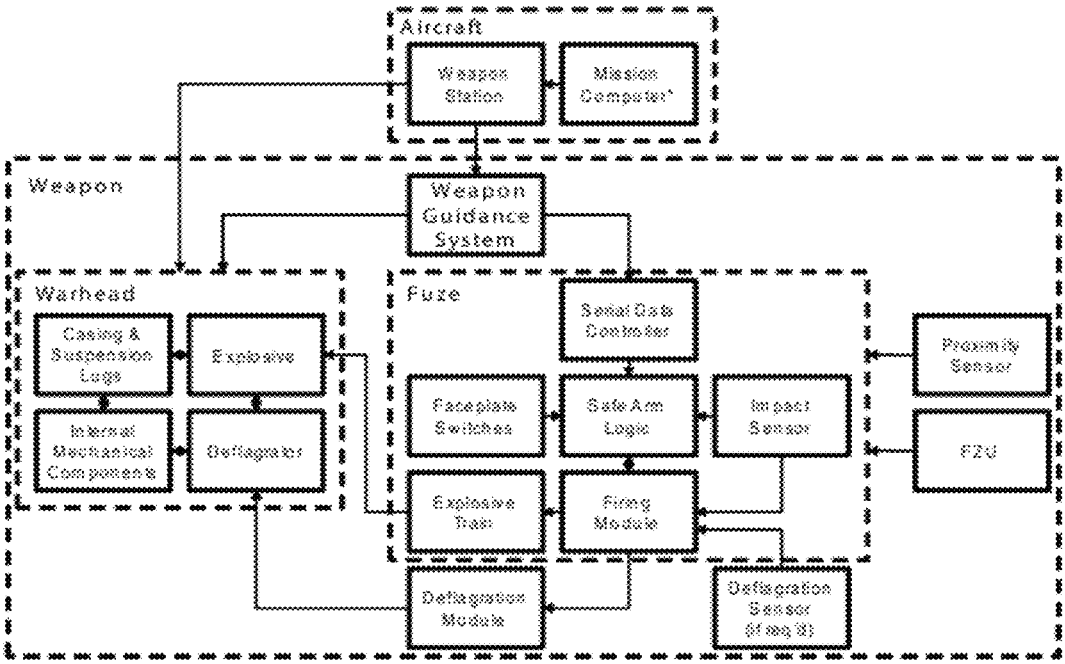
FIG. 10 is a system architecture of an explosive device in accordance with yet another embodiment of the present disclosure.
Figure 9:
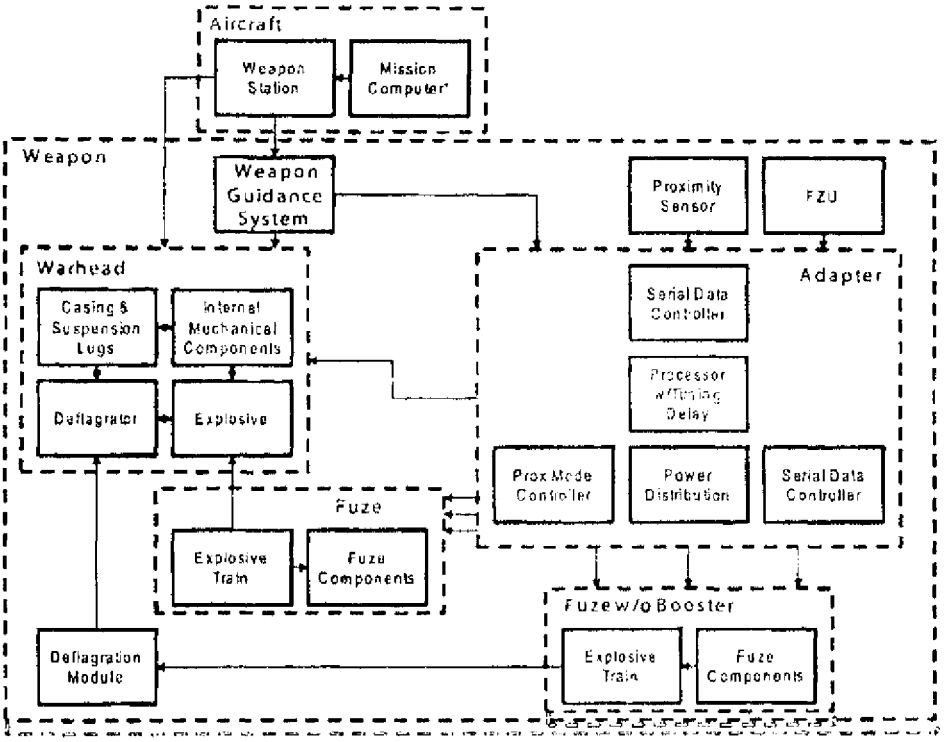
Figure 10:
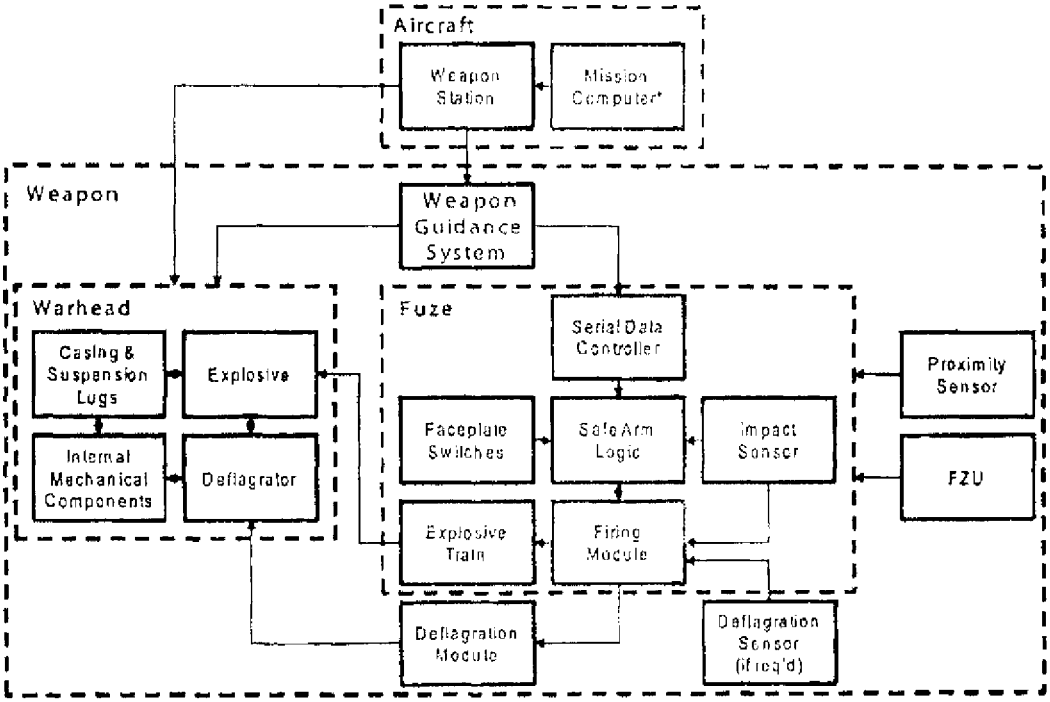

FIGS. 9 and 10 illustrate embodiments of system architectures that may be utilized in some embodiments of the initiation systems and explosive devices discussed herein. For example, as shown in FIGS. 9 and 10, an explosive device may include a warhead such as, for example, a BLU-111 including a scalable output weapon (SOW) that is enabled to be launched from a platform such as, for example, an aircraft.

In view of the above, embodiments of the present disclosure may be particularly useful in providing an initiation system enabling a scalable explosive output of an explosive device. Such scalability of an explosive device may enable an explosive device of one size (i.e., a weapon having a certain amount of explosive material therein) to be utilized for a variety of targets. That is, one size of an explosive device may be implemented to destroy a variety of target sizes and configuration while still supplying the capability of adequately destroying each target within a desired damage radius while minimizing collateral damage. The initiation system may also be implemented as a safety feature to burn away all explosive, providing a "self-destruct" mode if there is a guidance, navigation, and control (GNC) or other weapon failure. Furthermore, the components of the initiation system may be disposed on or near the centerline axis of the explosive device, minimizing mass property changes and the amount of explosive having to be removed from the explosive device when an embodiment of the initiation system is employed.

While the present disclosure may be susceptible to various modifications and alternative forms, specific embodiments have been shown by way of example in the drawings and have been described in detail herein. However, it should be understood that the disclosure is not intended to be limited to the particular forms disclosed. Rather, the disclosure includes all modifications, equivalents, legal equivalents, and alternatives falling within the scope of the disclosure as defined by the following appended claims.

What is claimed is:

1. A scalable output explosive device, comprising:

a projectile warhead comprising an elongated housing having a forward end at a first longitudinal end of the elongated housing, and an aft end at a second longitudinal end of the elongated housing opposing the first elongated end of the housing, the forward end configured to form a frontmost portion of the projectile warhead during travel of the projectile warhead through air, the aft end configured to form a backmost portion of the projectile warhead during travel of the projectile type warhead through air, wherein a length of the elongated housing extending between the forward end and the aft end is greater than a width of the elongated housing extending in a direction transverse to the length, the projectile warhead comprising:

an explosive material disposed within a housing in the warhead; and an initiator system disposed within the housing, the initiator system comprising:

a first initiation device disposed proximate to the aft end of the warhead and configured to detonate at least a portion of the explosive material; and a second initiation device at least partially disposed in a cavity formed in the explosive material proximate to the forward end of the warhead and configured to deflagrate at least another portion of the explosive material of the explosive device.

2. The explosive device of claim 1, further comprising a guidance system coupled to the housing at the forward end of the warhead.

3. The explosive device of claim 1, wherein the warhead is configured to be delivered to a target by at least one of a propulsion system and an aircraft.

4. The explosive device of claim 1, further comprising:

at least one vent formed in the housing at the forward end; and at least another vent formed in the housing at the aft end.

5. The explosive device of claim 4, wherein the at least one vent comprises a thermoplastic ring disposed around an outer portion of a fuze well in which the second initiation device is disposed.

6. The explosive device of claim 1, wherein the initiator system is configured to delay ignition of the first initiation device after ignition of the second initiation device.

7. The explosive device of claim 6, wherein the delay is a selectable, variable time delay.

8. The explosive device of claim 1, wherein the first initiation device and the second initiation device each comprise a detonator device comprising at least one of an exploding foil initiator (EFI), a low energy exploding foil initiator (LEEFI), a blasting cap, and an exploding-bridgewire detonator (EBW).

9. The explosive device of claim 8, wherein the second initiation device further comprises a deflagration device comprising a housing filled with an explosive material, the deflagration device configured to initiate a subsonic combustion of at least a portion of the explosive material.

10. The explosive device of claim 9, wherein the first initiation device further comprises an explosive booster.

11. The explosive device of claim 1, wherein the initiator system is configured to delay ignition of the first initiation device until after ignition of the second initiation device.

12. The explosive device of claim 11, wherein the delay is a selectable, variable time delay.

13. A method of igniting a warhead, the method comprising:

deflagrating a portion of the explosive material disposed within a projectile warhead comprising an elongated housing having a forward end at a first longitudinal end of the elongated housing and an aft end at a second longitudinal end of the elongated housing opposing the first elongated end of the housing, the forward end configured to form a frontmost portion of the projectile warhead during travel of the projectile warhead through air, the aft end configured to form a backmost portion of the projectile warhead during travel of the projectile type warhead through air, wherein a length of the elongated housing extending between the forward end and the aft end is greater than a width of the elongated housing extending in a direction transverse to the length, the projectile warhead comprising:

an explosive material disposed within a housing in the warhead; and an initiator system disposed within the housing, the initiator system comprising:

a first initiation device disposed proximate to the aft end of the warhead and configured to detonate at least a portion of the explosive material; and a second initiation device at least partially disposed in a cavity formed in the explosive material proximate to the forward end of the warhead and configured to deflagrate at least another portion of the explosive material of the explosive device; and detonating at least a portion of the explosive material disposed within the warhead with the initiator system.

14. The method of claim 13, wherein deflagrating a portion of the explosive material disposed within the warhead comprises igniting the second initiation device to deflagrate the portion of the explosive material and wherein detonating at least another portion of the explosive material disposed within the warhead comprises igniting the first initiation device to generate a shock wave through the at least another portion of the explosive material.

15. The method of claim 14, further comprising delaying detonation of the at least another portion of the explosive material for a selected amount of time after initiation of the deflagration device.

16. The method of claim 15, wherein delaying detonation of the at least another portion of the explosive material for a selected amount of time after initiation of the deflagration device comprises selecting a variable time delay.

17. The method of claim 13, wherein deflagrating a portion of the explosive material disposed within the warhead comprises propagating a subsonic combustion through the portion of the explosive material and wherein detonating at least another portion of the explosive material disposed within the warhead comprises propagating a supersonic shock wave through the another portion of the explosive material.

* * * * *

UNITED STATES PATENT AND TRADEMARK OFFICE

CERTIFICATE OF CORRECTION

PATENT NO. : 8,931,415 B2
APPLICATION NO. : 13/181131
DATED : January 13, 2015
INVENTOR(S) : Eric Volkmann It is certified that error appears in the above-identified patent and that said Letters Patent is hereby corrected as shown below:

In the drawings:

| | |
|---|---|
| In FIG. 9, | replace figure with legible text (See attached) |
| In FIG. 10, | replace figure with legible text (See attached) |

In the specification:

| | | |
|---|---|---|
| COLUMN 3, | LINE 23, | change "("CL -20")," to --("CL-20"),-- |

In the claims:

| | | | |
|---|---|---|---|
| CLAIM 1, | COLUMN 9, | LINE 47, | change "projectile type" to --projectile-- |
| CLAIM 13, | COLUMN 10, | LINE 46, | change "projectile type" to --projectile-- |

Signed and Sealed this
Twenty-eighth Day of July, 2015

Michelle K. Lee

Michelle K. Lee
*Director of the United States Patent and Trademark Office*